US009067724B2

(12) United States Patent
Yamada

(10) Patent No.: US 9,067,724 B2
(45) Date of Patent: Jun. 30, 2015

(54) WET TISSUE PACKAGE

(76) Inventor: Kikuo Yamada, Tokyo (JP)

( * ) Notice: Subject to any disclaimer, the term of this patent is extended or adjusted under 35 U.S.C. 154(b) by 0 days.

(21) Appl. No.: 14/234,431

(22) PCT Filed: Jul. 19, 2012

(86) PCT No.: PCT/JP2012/004598
§ 371 (c)(1),
(2), (4) Date: Jan. 23, 2014

(87) PCT Pub. No.: WO2012/024566
PCT Pub. Date: Feb. 21, 2013

(65) Prior Publication Data

US 2014/0190859 A1 Jul. 10, 2014

(30) Foreign Application Priority Data

Aug. 12, 2011 (JP) ..... 2011-176554

(51) Int. Cl.
*B65H 1/00* (2006.01)
*B65D 73/00* (2006.01)
*B65D 81/22* (2006.01)
(Continued)

(52) U.S. Cl.
CPC ..... *B65D 81/22* (2013.01); *B65D 75/5838* (2013.01); *B65D 83/0805* (2013.01); *B65D 83/0894* (2013.01); *A47K 2010/3266* (2013.01)

(58) Field of Classification Search
CPC ..... B65D 75/5838; B65D 83/0805; B65D 83/0894; B65D 81/22; A47K 2010/3266; A47K 10/3818
USPC ..... 206/205, 233, 449, 494, 812; 221/33, 221/34, 45, 63, 267, 303, 306; 383/66, 211
See application file for complete search history.

(56) References Cited

U.S. PATENT DOCUMENTS 4,289,262 A * 9/1981 Finkelstein ..... 221/63
4,848,575 A * 7/1989 Nakamura et al. ..... 206/449
(Continued)

FOREIGN PATENT DOCUMENTS

JP U-55-177796 12/1980
JP U-60-146494 9/1985
(Continued)

OTHER PUBLICATIONS

Oct. 23, 2012 International Search Report issued in International Application No. PCT/JP2012/004598, (2 pages).
(Continued)

*Primary Examiner* — Luan K Bui
(74) *Attorney, Agent, or Firm* — Oliff PLC

(57) ABSTRACT

A wet tissue package having a folded wet tissue body that has a separation section formed so that the wet tissues can separate. A housing container houses the folded wet tissue body and has an opening formed for the wet tissues configuring the housed folded wet tissue body to be pulled out therefrom. The wet tissue package also has a base plate attached to the opening and to which a notch section has been formed at a predetermined position. The notch section has a plucking hole and a portion of the opening's edge of the base plate that is attached to the opening. The notch section is provided with a removal hole that interconnects with the plucking hole and separates a wet tissue from the wet tissue body at the separation section. The wet tissue package also has a lid that can seal the plucking hole and removal hole.

8 Claims, 11 Drawing Sheets

(51) Int. Cl.

| | |
|---|---|
| ***B65D 75/58*** | (2006.01) |
| ***B65D 83/08*** | (2006.01) |
| *A47K 10/32* | (2006.01) |

(56) References Cited

U.S. PATENT DOCUMENTS

| | | | | |
|---|---|---|---|---|
| 5,542,567 | A * | 8/1996 | Julius | 221/63 |
| 5,582,294 | A * | 12/1996 | Yamada | 206/494 |
| 5,729,955 | A * | 3/1998 | Yamada | 206/494 |
| 5,908,246 | A * | 6/1999 | Arimura et al. | 383/66 |
| 5,938,013 | A * | 8/1999 | Palumbo et al. | 206/812 |
| 6,394,298 | B1 * | 5/2002 | Zaidman | 206/494 |
| 6,910,579 | B2 * | 6/2005 | Reinke et al. | 206/494 |
| 7,216,775 | B2 * | 5/2007 | Evans et al. | 221/63 |
| 8,245,865 | B2 * | 8/2012 | Damaghi et al. | 220/254.5 |

FOREIGN PATENT DOCUMENTS

| | | |
|---|---|---|
| JP | A-1-226579 | 9/1989 |
| JP | U-4-56638 | 5/1992 |
| JP | A-7-206055 | 8/1995 |
| JP | A-2006-182431 | 7/2006 |
| JP | A-2007-217054 | 8/2007 |

OTHER PUBLICATIONS

Feb. 18, 2014 International Preliminary Report on Patentability issued in International Patent Application No. PCT/JP2012/004598 (with English Translation).

* cited by examiner

WET TISSUE PACKAGE

TECHNICAL FIELD

The present invention relates to a wet tissue package.

BACKGROUND ART

A wet tissue has been widely used for various purposes of wiping a body and the like. The wet tissue is formed as a web sheet that is formed by impregnating a chemical solution and the like into a ground fabric, and is generally accommodated in a sealed accommodation container so that the ground fabric may be maintained in a wet state by the chemical solution and the like. As the accommodation container, a cylindrical bottle type container has been widely used from the past (for example, see Patent Literatures 1 and 2).

As illustrated in FIG. 15, a wet tissue accommodation body 201 disclosed in Patent Literature 1 includes a roll-shaped wet tissue 202 into which a chemical solution and the like are impregnated and a bottle type accommodation container 203 which accommodates the wet tissue 202. The roll-shaped wet tissue 202 is formed by winding a thin-stripe-shaped elongated web sheet, the web sheet is provided with a perforation line 204 of which the extension direction follows the width direction of the web sheet. Further, a plurality of the perforation lines 204 are formed at a predetermined interval in the longitudinal direction of the web sheet. The accommodation container 203 is formed so that a container lid 206 is detachably provided in an upper portion of a container body 205, and may accommodate the roll-shaped wet tissue 202 therein. A small hole 207 having a substantially circular shape is formed at the center of the container lid 206, and the wet tissue 202 is drawn out from the small hole 207. The small hole 207 is formed in a size in which a resistance force capable of separating the drawn wet tissue 202 by the perforation lines 204 is applied to the drawn wet tissue 202 when the front end of the roll-shaped wet tissue 202 is drawn out from the inside of the accommodation container 203. Further, the container lid 206 is provided with an openable/closable cover 208 that seals the inside of the accommodation container 203.

Further, a wet tissue accommodation container disclosed in Patent Literature 2 is formed so as to accommodate a roll-shaped wet tissue therein, and an upper cover is attached to the upper portion thereof. The upper surface of the upper cover is provided with an extraction hole through which the wound end of the roll-shaped wet tissue is plucked out, a cutting and separating hole which separates the extracted wet tissue, and a connection hole which connects the extraction hole to the cutting and separating hole and guides the wet tissue extracted from the extraction hole to the cutting and separating hole.

CITATION LIST

Patent Literatures

Patent Literature 1: JP 4-56638 Y
Patent Literature 2: JP 2007-217054 A

SUMMARY OF INVENTION

Technical Problem

A wet tissue package disclosed in Patent Literature 1 may apply a resistance force capable of separating the wet tissue by the perforation lines to the wet tissue by decreasing the hole diameter of the small hole. For this reason, a problem arises in that the front end of the roll-shaped wet tissue may not easily pass through the small hole and the front end of the wet tissue may not be easily extracted to the outside. Further, in the case of the wet tissue package disclosed in Patent Literature 1, the wet tissue is extracted to the outside while being squeezed and wrinkled by the small hole due to the passage through the small hole. For this reason, a user needs to inevitably stretch the squeezed wet tissue whenever extracting the wet tissue. Accordingly, it takes more time in the work in which the user extracts the wet tissue for the wiping purpose, and hence a problem arises in that the workability is very poor.

Even in the accommodation container disclosed in Patent Literature 2, the hole diameter of the cutting and separating hole is formed in a small size so that the resistance force capable of separating the wet tissue by the perforation lines may be applied to the wet tissue, and the drawn wet tissue is extracted to the outside while being wrinkled. For this reason, the user needs to stretch the squeezed wet tissue whenever extracting the wet tissue. Accordingly, it takes more time in the work in which the user extracts the wet tissue for the wiping purpose, and hence the workability is very poor. Further, in the accommodation container disclosed in Patent Literature 2, the extraction hole used to extract the wet tissue is formed separately from the cutting and separating hole used to separate the wet tissue, and the wet tissue accommodated in the accommodation container is formed in a roll shape. Accordingly, the user needs to perform a series of work in which the wet tissue is extracted from the extraction hole, the wet tissue is moved from the extraction hole to the cutting and separating hole, and the wet tissue is extracted to the outside from the cutting and separating hole. As a result, a problem arises in that the work becomes more complicated due to the additional work.

Further, since the roll-shaped wet tissue is generally accommodated vertically in the accommodation container of the bottle type wet tissue package, the accommodation container is inevitably formed in the vertical long shape, and hence a problem arises in that the bottle type wet tissue package may not be easily decreased in size. Further, in the bottle type wet tissue package, the accommodation container increases in size, and hence a problem arises in that the manufacturing cost increases.

The present invention is made in view of such problems, and an object thereof is to provide a compact wet tissue package that causes a user to easily extract a wet tissue from an accommodation container and reduces the manufacturing cost thereof.

Solution to Problem

The present invention may be summarized as below.

(1) A wet tissue package comprising: a folded wet tissue body that includes a planned separation portion formed to separate a wet tissue; an accommodation container that is formed so as to accommodate the folded wet tissue body therein and is provided with an opening through which the wet tissue forming the accommodated folded wet tissue body is drawable to the outside; a base plate that is attached to the opening and forms a notch portion at a predetermined position of the base plate, wherein the notch portion is formed so that a plucking hole, through which the wet tissue is plucked to the outside, is formed by the notch portion and a part of the edge of the opening while the base plate is attached to the opening; an extraction hole that communicates with the plucking hole and is formed so that the wet tissue is separable from the folded wet tissue body at the planned separation portion; and a lid that is formed in an openable and closable manner so as to seal the plucking hole and the extraction hole.

(2) The wet tissue package according to (1), wherein the notch portion includes an extension portion that extends toward the extraction hole and communicates with the extraction hole, and the extension portion is formed in a sequentially tapered shape as it goes toward the extraction hole and communicates with the extraction hole.

(3) The wet tissue package according to (1) or (2), wherein the base plate is provided with an extraction hole forming portion formed of an elastic material, and wherein the extraction hole is formed in the extraction hole forming portion.

(4) The wet tissue package according to (3), wherein the base plate includes an extraction hole forming member and a base plate body provided with an attachment portion forming an extraction hole forming portion by attaching the extraction hole forming member thereto, wherein the extraction hole forming member is provided with a hole portion that is attached to the attachment portion, and wherein the attachment portion is provided with a boss that is press-insertable into the hole portion.

(5) The wet tissue package according to (3), wherein the base plate includes an extraction hole forming member and a base plate body provided with an attachment portion forming an extraction hole forming portion by attaching the extraction hole forming member thereto, wherein the extraction hole forming portion is provided with a rib that protrudes outward from the outer periphery of the extraction hole forming portion, and wherein the attachment portion is provided with a locking hole to which the rib is lockable.

(6) The wet tissue package according to (3), wherein the base plate includes an extraction hole forming member, a base plate body provided with an attachment portion forming an extraction hole forming portion by attaching the extraction hole forming member thereto, and a fixing member that attaches and fixes the extraction hole forming portion to the attachment portion, wherein the fixing member is provided with a fixing hole through which a boss is insertable and a protrusion portion is formed so as to protrude outward from the outer periphery of the fixing member, and wherein the attachment portion is provided with a locking hole to which the protrusion portion is lockable.

Advantageous Effects of Invention

According to the present invention, it is possible to obtain the wet tissue package in which the user may easily pluck the front end of the wet tissue when plucking out the wet tissue. Further, when the wet tissue that is drawn out from the plucking hole is raised upward, the drawing position moves from the plucking hole to the extraction hole. Accordingly, it is possible to reduce the effort or the complicatedness in operation in which the user moves the position of drawing the wet tissue from the plucking hole to the extraction hole.

BRIEF DESCRIPTION OF DRAWINGS

FIG. 1 is an external perspective view illustrating the external configuration of a wet tissue package according to a first embodiment of the present invention, where

FIG. 3 is a view illustrating the configuration of a folded wet tissue body, where

FIG. 4 is a schematic view illustrating another embodiment of the folded wet tissue body, where

DESCRIPTION OF EMBODIMENTS

First Embodiment

Figure 1A:
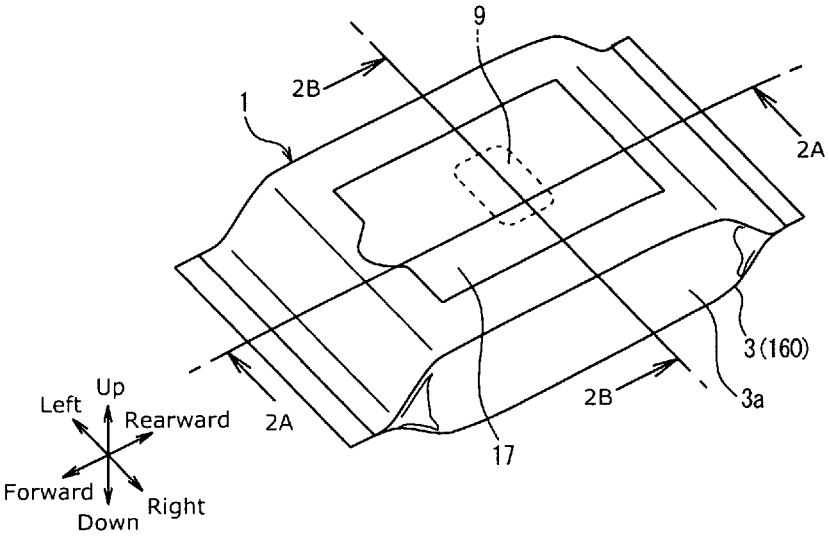
FIG. 1A is a view illustrating a state where a lid is closed and FIG. 1B illustrates a state where the lid is opened.
Figure 1B:
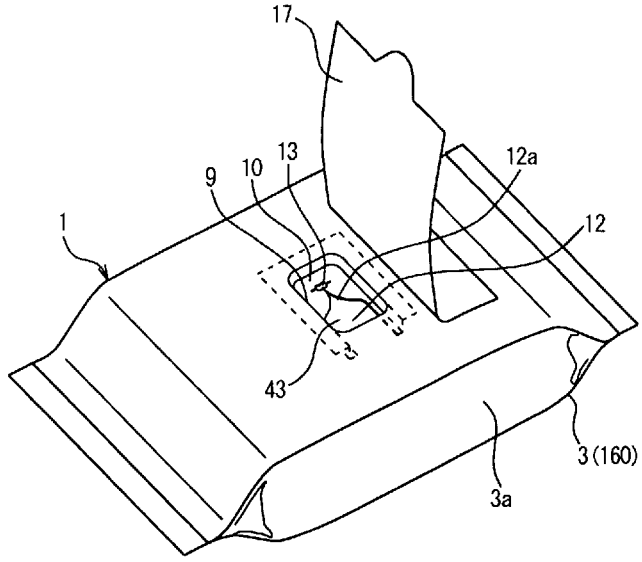
Figure 2A:
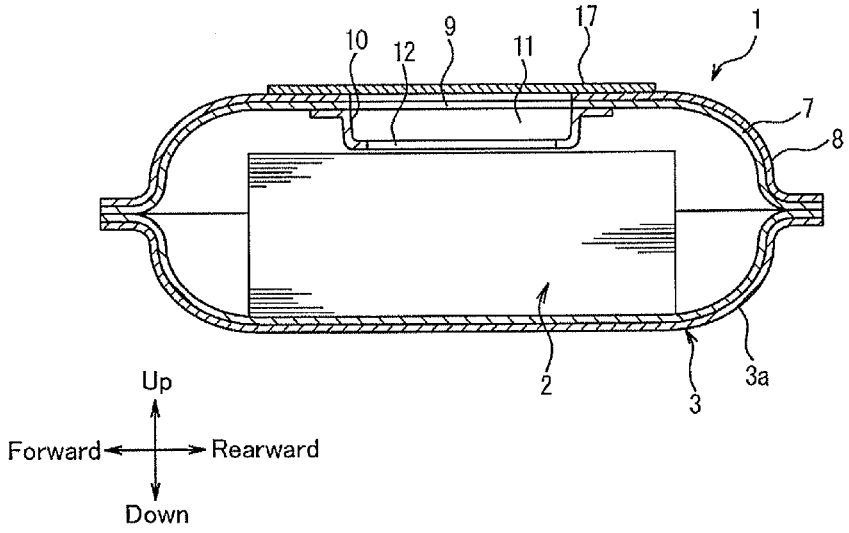
FIG. 2A is a cross-sectional view taken along the line 2A-2A of FIG. 1A
Figure 2B:
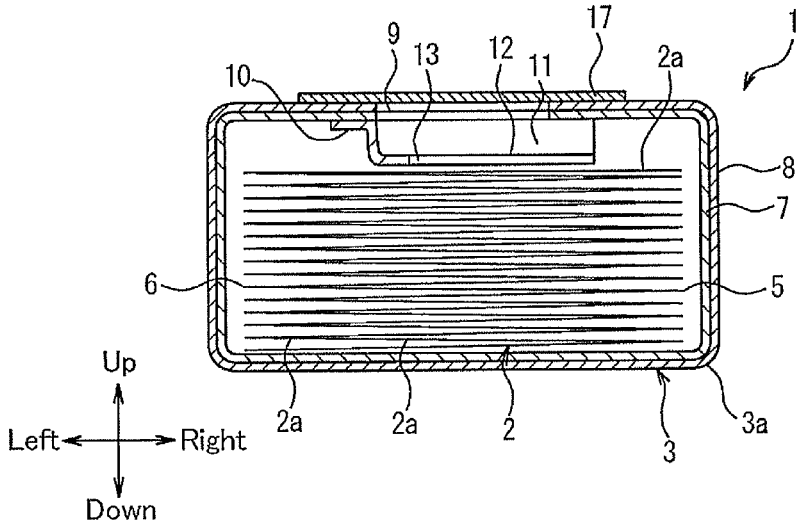
FIG. 2B is a cross-sectional view taken along the line 2B-2B of FIG. 1A.
Figure 3A:
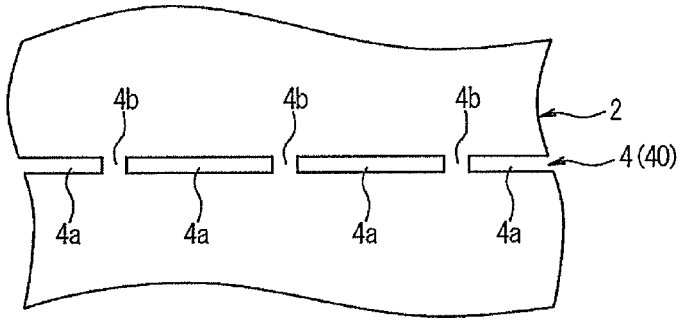
FIG. 3A is a partially enlarged view illustrating the configuration of a planned portion to separate the folded wet tissue body and FIG. 3B is an explanatory view illustrating the position of the planned portion to separate the folded wet tissue body.
Figure 3B:
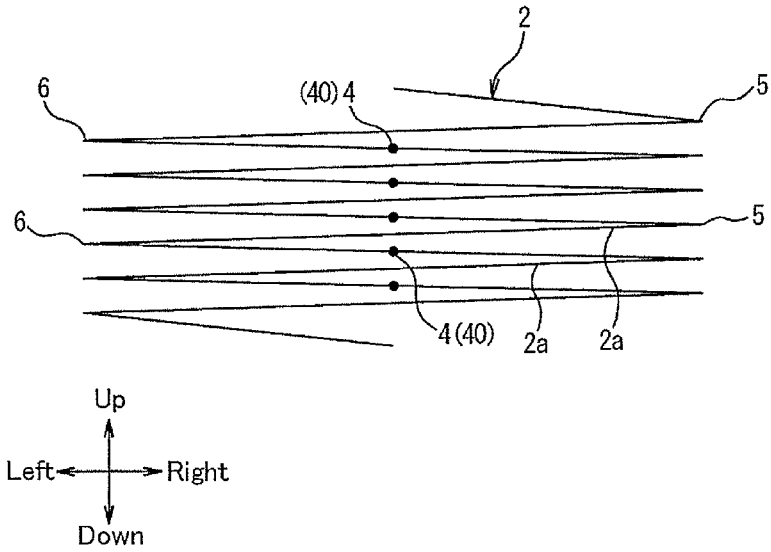
Figure 4A:
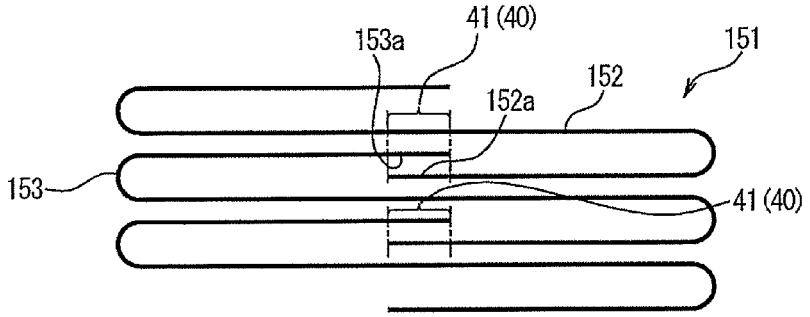
FIG. 4A is a view illustrating the folded wet tissue body that is folded in a Z-shape as so called and FIG. 4B is a view illustrating the folded wet tissue body that is folded in a WZ-shape as so called.
Figure 4B:
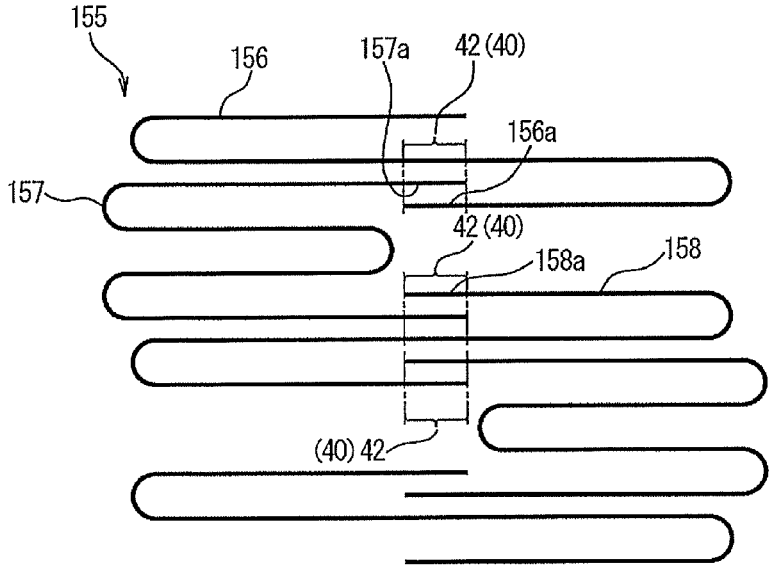
Figure 5:
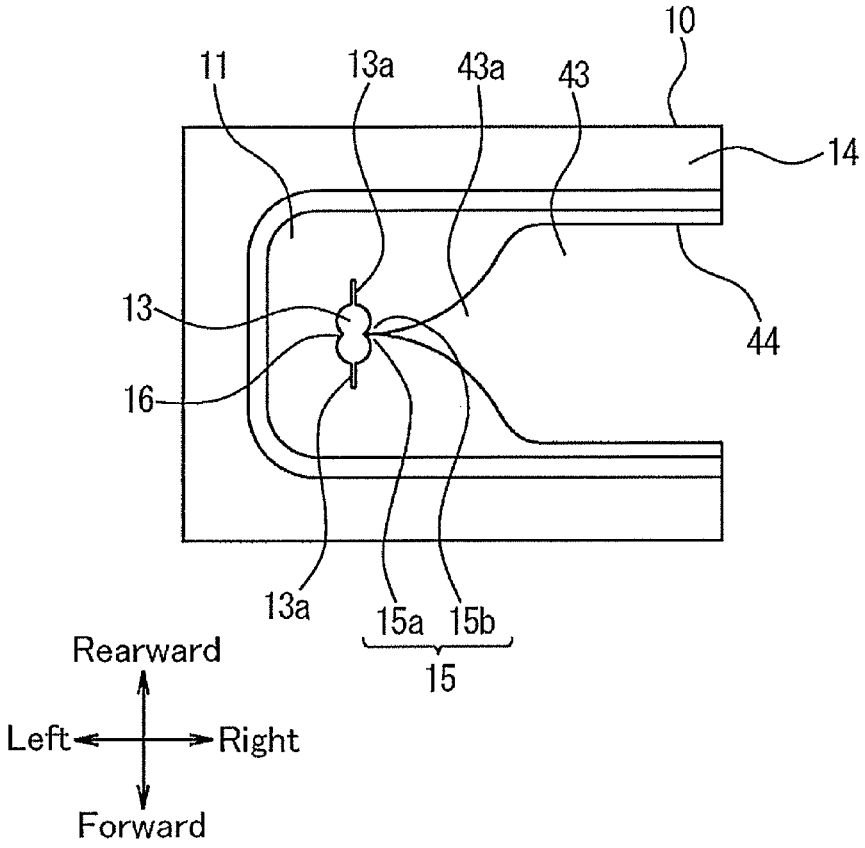
FIG. 5 is a top view illustrating the configuration of a base plate.

A first embodiment of a wet tissue package according to the present invention will be described with reference to FIGS. 1 to 5. FIG. 1 is an external perspective view illustrating the external configuration of a wet tissue package according to a first embodiment of the present invention, where FIG. 1A is a view illustrating a state where a lid is closed and FIG. 1B illustrates a state where the lid is opened. FIG. 2 is a cross-sectional view illustrating the wet tissue package of this embodiment, where FIG. 2A is a cross-sectional view taken along the line 2A-2A of FIG. 1A and FIG. 2B is a cross-sectional view taken along the line 2B-2B of FIG. 1A. FIG. 3 is a view illustrating the configuration of the folded wet tissue body according to this embodiment, where (FIG. 3A is a partially enlarged view illustrating the configuration of a planned portion to separate the folded wet tissue body and FIG. 3B is an explanatory view illustrating the position of the planned portion to separate the folded wet tissue body. FIG. 4 is a schematic view illustrating another embodiment of the folded wet tissue body, where FIG. 4A is a view illustrating the folded wet tissue body that is folded in a Z-shape as so called and FIG. 4B is a view illustrating the folded wet tissue body that is folded in a WZ-shape as so called. FIG. 5 is a front view illustrating the configuration of the base plate. Furthermore, it is assumed that the up-down direction (i.e. the vertical direction), the front-back direction (i.e. the forward and backward direction), and the left-right direction in the present specification respectively indicate the up-down direction, the front-back direction, and the left-right direction illustrated in FIG. 1. Further, it is assumed that the "front end of the wet tissue" of the present specification indicates the end close to the extraction hole formed in the base plate in the folded wet tissue body accommodated in the accommodation container. Furthermore, in the present specification, an example will be described in which a bag body is used as one kind of the accommodation container, but any member other than the bag body may be used as the accommodation container.

<Wet Tissue Package 1>

As illustrated in FIGS. 1 and 2, a wet tissue package 1 according to this embodiment has a structure in which a folded wet tissue body 2 is accommodated in a bag body 3.

(Folded Wet Tissue Body 2)

The folded wet tissue body 2 is obtained by impregnating a chemical solution and the like into a ground fabric such as a web sheet. The folded wet tissue body 2 has a structure in which the web sheet is folded. In a state where the folded web sheet is unfolded, that is, the web sheet is not folded, the web sheet has a structure in which a plurality of small web sheet pieces are continued. For example, the web sheet may have a sheet structure in which small web sheet pieces are continuously continued. Further, the web sheet may have a sheet structure in which a plurality of small web sheet pieces are arranged in series in facial order while partially overlapping one another. In the folded wet tissue body 2, a plurality of turnback portions are formed by turning the web sheet forming the wet tissue back. As illustrated in FIG. 2, a first turnback portion 5 and a second turnback portion 6 are formed as the turnback portions. A plurality of planned portions 4 (i.e. a plurality of planned disjoining portions 4) to disjoin the folded wet tissue body 2 as a plurality of planned portions 40 (i.e. a plurality of planned separation portions 40) to separation the folded wet tissue body 2 are formed in the folded wet tissue body 2 at intervals, and in the example of FIG. 3, a plurality of planned portions to disjoin the folded wet tissue body 2 are formed repeatedly at a predetermined interval. Furthermore, in the present specification, a wet tissue 2*a* indicates a wet tissue that is separated from the folded wet tissue body 2 at the planned portion 40 to separate the folded wet tissue body 2. Furthermore, the wet tissue 2*a* of the present specification indicates a sheet-like small web sheet piece that is separated from the folded wet tissue body 2, but may indicate a web sheet that is not separated from the folded wet tissue body 2 yet.

(Planned Portions 40 to Separation the Folded Wet Tissue Body)

The planned portion 40 to separation the folded wet tissue body indicates a portion that is planned as a separation portion between the folded wet tissue body and the wet tissue when the wet tissue 2*a* is taken out from the folded wet tissue body 2. The planned portion 40 to separation the folded wet tissue body is formed so that the wet tissue 2*a* may be separated, and is formed in the web sheet forming the folded wet tissue body 2. In the example of FIG. 3, the planned portion 4 to disjoin the folded wet tissue body as the planned portion 40 to separation the folded wet tissue body is formed in the folded wet tissue body 2. The planned portion 4 to disjoin the folded wet tissue body is formed so that the planned portion to disjoin the folded wet tissue body may be separated by the drawing tensile force applied to the wet tissue 2*a* when the wet tissue 2*a* is drawn out. As illustrated in FIG. 3A, the planned portion 4 to disjoin the folded wet tissue body is provided with a plurality of spaces 4*a* that are formed at the same interval in the width direction of the folded wet tissue body 2, and a connection portion 4*b* is formed between the spaces 4*a* so as to connect the folded wet tissue bodies 2. In this embodiment, the connection portion 4*b* is formed at three positions in the width direction of the folded wet tissue body 2, but the number or the shape of the connection portion 4*b* is not limited thereto. Further, the planned portion 4 to disjoin the folded wet tissue body may be formed so that the planned portion to disjoin the folded wet tissue body may be separated when a drawing tensile force is applied thereto. For example, the planned portion to disjoin the folded wet tissue body may be formed in a perforation line shape by shortening the gap between the space 4*a* and the connection portion 4*b* or may be formed in another shape. In such a case, in the state of the folded wet tissue body 2, the wet tissues 2*a* are continuously connected by the planned portion 4 to disjoin the folded wet tissue body, and hence are formed in an elongated web shape as a whole.

FIG. 3B is an explanatory view illustrating a position where the planned portion 4 to disjoin the folded wet tissue body 2 is located at the elongated web sheet forming the folded wet tissue body 2. In this drawing, the black circle indicates the position of the planned portion 4 to disjoin the folded wet tissue body 2. As illustrated in FIG. 3B, when the portion interposed between the first turnback portion 5 and the second turnback portion 6 adjacent to each other along the web surface of the elongated web sheet in the folded wet tissue body 2 is viewed, the planned portion 4 to disjoin the folded wet tissue body 2 is located at the center portion between the first turnback portion 5 and the second turnback portion 6. Furthermore, as the vertical relation, the portion interposed between the first turnback portion 5 and the second turnback portion 6 adjacent to each other is formed by alternating a portion with the planned portion 4 to disjoin the folded wet tissue body 2 and a portion without the planned portion 4 to disjoin the folded wet tissue body 2.

Furthermore, the configuration of the folded wet tissue body 2 is not limited to the above-described configuration, and may be formed in any shape as long as the folded wet tissue body may be accommodated in the bag body 3. For example, in this embodiment, the position of the planned portion 4 to disjoin the folded wet tissue body 2 is located at the center portion between the first turnback portion 5 and the second turnback portion 6. However, the planned portion 4 to disjoin the folded wet tissue body 2 may be disposed at a position other than the center portion. Further, the planned portion 4 to disjoin the folded wet tissue body 2 may be disposed at a position where the first turnback portion 5 or the second turnback portion 6 is formed. Further, in this embodiment, as for the vertical relation of the folded wet tissue body 2, the portion interposed between the first turnback portion 5 and the second turnback portion 6 is formed by alternating the portion with the planned portion 4 to disjoin the folded wet tissue body 2 and the portion without the planned portion 4 to disjoin the folded wet tissue body 2, but may folded so that the portions with the planned portion 4 to disjoin the folded wet tissue body 2 overlap each other in the vertical direction. Further, the planned portion 4 to disjoin the folded wet tissue body 2 may be located at both positions where the first turnback portion 5 and the second turnback portion 6 are formed.

Furthermore, various existing materials may be used as the base material for the folded wet tissue body 2. Further, various existing chemical solutions and the like may be used as the chemical solution that is impregnated into the base material of the folded wet tissue body 2 of this embodiment.

(Another Example of Folded Wet Tissue Body)

The folded wet tissue body that is accommodated in the wet tissue package 1 is not limited to the folded wet tissue body 2 including the above-described planned portion 40. For example, the wet tissue package 1 may accommodate the following folded wet tissue body instead of the folded wet tissue body 2.

That is, the wet tissue package 1 may accommodate a folded wet tissue body having a folded structure in which the separate wet tissues 2*a* are folded in a predetermined folding pattern while partially overlapping one another instead of the folded wet tissue body 2. Such a folded wet tissue body is formed in a web sheet folded structure in which wet tissue folded in a predetermined pattern is used as the small web sheet pieces and the small web sheet pieces are piled while the ends of the separate small web sheet pieces overlap one another. FIG. 4 is a schematic view illustrating an example of the folded wet tissue body. FIG. 4A illustrates the configuration of a folded wet tissue body 151 that has a folded structure formed by a Z-shaped folding method as so called, and FIG. 4B illustrates the configuration of a folded wet tissue body 155 that has a folded structure formed by a WZ-shaped folding method as so called. Furthermore, the folded structure of the folded wet tissue body may be a folded structure in which the next wet tissue is sequentially raised so as to pop up when the current wet tissue is raised. The folded structure of the folded wet tissue body may be a folded structure in which the folded wet tissue body is folded in a W-shape other than the Z-shape or the WZ-shape. The folded structure of the folded wet tissue body may be a folded structure in which the folded wet tissue body is folded in a shape other than the W-shape, the Z-shape or the WZ-shape.

As illustrated in FIG. 4A, the folded wet tissue body 151 having a Z-shaped folded structure is formed by piling a plurality of wet tissues folded in a Z-shape. Further, the folded wet tissue body 151 is formed by sequentially piling a plurality of wet tissues while forming the overlap portion 41 in which an upper surface of a termination end 152*a* of a wet tissue 152 overlaps a lower surface of a start end 153*a* of a next wet tissue 153. When the wet tissue 152 is drawn out from the folded wet tissue body 151, an acting force is exerted on the wet tissue 153 so that the termination end 152*a* of the wet tissue 152 raises the start end 153*a* of the next wet tissue 153 in the overlap portion 41. Then, when the start end 153*a* of the next wet tissue 153 is drawn out to the outside of the bag body from an extraction hole (not illustrated), the termination end 152*a* of the wet tissue 152 is separated from the start end 153*a* of the next wet tissue 153. At this time, the wet tissue is separated from the folded wet tissue body 151 at the overlap portion 41. That is, in such a folded wet tissue body 151, the overlap portion 41 is formed as planned portion 40 to separation the folded wet tissue body.

As illustrated in FIG. 4B, the folded wet tissue body 155 that is folded in a WZ-shape is formed by alternately piling a wet tissue 156 folded in a Z-shape and a wet tissue 157 folded in a W-shape. Here, the wet tissue 156 folded in a Z-shape and the wet tissue 157 folded in a W-shape form an overlap portion 42 by overlapping the start end of one wet tissue and the termination end of the other wet tissue. In the case of FIG. 3B, the wet tissues are piled so that an upper surface of a termination end 156*a* of the wet tissue 156 folded in a Z-shape overlaps a lower surface of a start end 157*a* of the next wet tissue 157 folded in a W-shape. When the wet tissue 156 folded in a Z-shape is drawn out, an acting force is exerted on the wet tissue 157 so that the termination end 156*a* of the wet tissue 156 raises the start end 157*a* of the next wet tissue 157 folded in a W-shape at the overlap portion 42. Then, when the start end 157*a* of the wet tissue 157 folded in a W-shape is drawn out to the outside of the bag body from an extraction hole (not illustrated), the termination end 156*a* of the wet tissue 156 folded in a Z-shape is separated from the start end 157*a* of the next wet tissue 157 folded in a W-shape. Furthermore, the wet tissue is raised by the same action even when the start end 158*a* of the wet tissue 158 folded in a Z-shape is drawn out after the wet tissue 157 folded in a W-shape is drawn out. At this time, the wet tissue is separated from the folded wet tissue body 151 at the overlap portion 42. That is, as the folded wet tissue body 151 having a Z-shaped folded structure, even the folded wet tissue body 155 folded in a WZ-shape is provided with the overlap portion 42 as the planned portion 40 to separation the folded wet tissue body (Bag Body 3)

The bag body 3 is included in the concept of an accommodation container 160 that accommodates the folded wet tissue body 2 therein. As illustrated in FIG. 1, the bag body 3 is formed by bonding a base plate 10 to the main bag body 3*a*. For example, the main bag body 3*a* is formed in a pillow-like bag shape by a sheet material such as a plastic film having air-tightness and flexibility. Further, the bag body 3 is formed so that both front and rear ends of the main bag body 3*a* are air-tightly sealed by heat-seal.

In the example illustrated in FIG. 2, the sheet material that forms the main bag body 3*a* of the bag body 3 is formed in a double-layer structure with an inner layer 7 and an outer layer 8. The material that is used in the inner layer 7 and the outer layer 8 may be appropriately selected. Specifically, in the inner layer 7, for example, a film formed of plastic such as polyethylene, polypropylene, polyester, polyamide, vinyl chloride, vinylidene chloride, and cellophane, a laminate film formed of two or more of these materials, a single film, or a complex film formed by laminating an aluminum foil on a laminate film may be used. In the outer layer 8, for example, a polyethylene terephthalate (PET) film may be used. Furthermore, the case where the main bag body 3*a* of the bag body 3 is formed by two layers, that is, the inner layer 7 and the outer layer 8 like this embodiment is an example of the bag body 3. Further, the structure of the sheet material that forms the main bag body 3*a* of the bag body 3 is not limited thereto, and may be formed as a multi-layer structure having three or more layers or a single-layer structure.

As illustrated in FIGS. 1 and 2, the main bag body 3*a* is provided with an opening 9. The opening 9 is formed in a size in which the base plate 10 to be described later is attachable to the opening.

(Base Plate 10)

The base plate 10 is attached to the position of the opening 9 of the main bag body 3*a*. It is desirable that the base plate 10 be placed on the inner surface of the main bag body 3*a* and be attached to the inner surface of the bag body 3 by hot-melt or the like in that the outer peripheral end surface of the base plate 10 may not be exposed. The base plate 10 is disposed so that an extraction hole 13 and a notch portion 43 face the opening 9. The material of the base plate 10 may be appropriately selected, but a plate-shaped member that is formed of a thermoplastic resin material such as polyethylene and polypropylene is desirably selected. As illustrated in FIGS. 2 and 5, the base plate 10 includes a concave portion 11 that is formed at the center thereof, the extraction hole 13 is opened to the bottom portion of the concave portion 11, and the notch portion 43 is formed at a predetermined position of the base plate 10. Furthermore, the reference numeral 14 of FIG. 5 indicates an area that forms an adhesion portion that is used when the base plate 10 adheres to the inner surface of the bag body 3 by heat-seal.

(Notch Portion 43)

The notch portion 43 may be formed in an appropriate shape such as a U-shape, a mountain shape, and a tongue shape in the top view of the base plate 10. A shape of the notch portion 43 is shown in the embodiment of FIGS. 1 and 5, which is notched from a predetermined position of the outer peripheral edge of the base plate 10 toward the extraction hole 13 of the concave portion 11 as one example. And the notch portion 43 forms a recessed portion 44 in the outer peripheral edge of the base plate 10 in the top view of the base plate 10. The notch portion 43 forms a part of the plucking hole 12 while the base plate 10 is attached to the bag body 3. The size of the notch portion 43 may be appropriately set, but it ensures the size in which the plucking hole 12 may be formed while the base plate is attached to the bag body 3. Further, the shape of the notch portion 43 may be formed in a shape in which the plucking hole 12 may be formed in a sufficient size while the base plate 10 is attached to the bag body 3.

Further, the notch portion 43 is provided with a notch extension portion 43*a*. The notch extension portion 43*a* is a portion that extends toward the extraction hole 13 and communicates with the extraction hole 13. Then, the notch extension portion 43*a* of the notch portion 43 is a portion which is sequentially tapered as it goes toward the extraction hole 13. The notch extension portion 43*a* is a portion that forms an extension portion 12*a* of the plucking hole 12 while the base plate 10 is attached to the bag body 3. Such a notch extension portion 43*a* may be formed by notching a predetermined portion inside the notch portion 43 in a tapered shape toward the extraction hole 13.

(Plucking Hole 12)

The plucking hole 12 is a hole through which the wet tissue 2*a* is plucked outward. As illustrated in FIG. 1, the plucking hole 12 is formed by the notch portion 43 and a part of the edge of the opening 9 by attaching the base plate 10 to the position of the opening 9 of the bag body 3. More specifically, the plucking hole 12 is formed in a portion that is surrounded by a portion exposed to the outside from the opening 9 in the portion along the peripheral edge of the notch portion 43 and a portion intersecting the notch portion 43 of the base plate 10 in the edge of the opening 9 while the lid 17 is separated from the wet tissue package 1 in the top view of the wet tissue package 1. Further, the plucking hole 12 is formed as a portion opened in a size in which the wet tissue 2*a* accommodated in the bag body 3 may be plucked. Furthermore, the top view of the wet tissue package 1 indicates the case where the wet tissue package 1 is viewed from the upside thereof in FIG. 1A or 2.

In the wet tissue package 1 of the present invention, there is a concern that the wet tissue may not be plucked from the plucking hole 12 by a comparatively thick finger of a user when the user tries to pluck the wet tissue. However, since a part of the plucking hole 12 is formed by the bag body 3 as described above, the wet tissue may be appropriately and easily plucked from the plucking hole 12 due to the flexibility of the bag body 3 even when the user has a comparatively thick finger, and hence the above-described concern may be prevented.

(Extraction Hole 13)

The extraction hole 13 may be set in an appropriate size as long as a function is ensured in which the wet tissue may be separated from the folded wet tissue body 2 by the planned separation portion 40. More specifically, the extraction hole 13 is formed so as to apply a friction resistance to the plucked wet tissue 2*a* while communicating with the notch portion 43, that is, the extension portion 12*a* of the plucking hole 12.

In the example of FIG. 1, the extraction hole 13 is formed in a shape in which two circles partially overlap each other, and a projection portion 15 is formed in a portion that is formed by the overlap of two circles so as to protrude toward the inside of the extraction hole 13. The projection portion 15 is formed so as to be in contact with the inner end of the notch extension portion 43*a*. In this embodiment, the projection portion 15 includes two protrusion portions 15*a* and 15*b*, and becomes closer to the position between the protrusion portions 15*a* and 15*b* as it goes toward the inner end of the notch extension portion 43. In the projection portion 15, it is possible to suppress the folded wet tissue body 2 that is drawn out from the inside of the extraction hole 13 from moving to the plucking hole 12 as the projection degree of the projection portion 15 increases. Accordingly, the friction resistance applied to the plucked folded wet tissue body 2 increases.

Further, the extraction hole 13 is provided with a protrusion 16 that is provided at a position facing the projection portion 15 so as to protrude toward the inside of the extraction hole 13. The protrusion 16 is used to increase the friction resistance applied to the plucked folded wet tissue body 2. Furthermore, the reference numeral 13*a* of FIG. 5 indicates a slit that is formed so as to extend from the extraction hole 13 in the front-back direction.

Furthermore, the shape and the size of the projection portion 15 are not limited as long as the friction resistance applied to the folded wet tissue body 2 may be increased and the movement of the plucked folded wet tissue body 2 from the inside of the extraction hole 13 to the plucking hole 12 may be prevented. Further, the shape and the size of the protrusion 16 are not limited as long as the friction resistance applied to the folded wet tissue body 2 may be increased.

In this way, in the wet tissue package 1, the extraction hole 13 is provided with the projection portion 15 and the protrusion 16, and the projection portion 15 and the protrusion 16 may be disposed so that the gap between the projection portion 15 and the protrusion 16 partially narrows the extraction hole 13. In this case, even when the hole diameter of the extraction hole 13 is not set to a small size beyond necessity, an appropriate resistance force may be applied to the wet tissue 2*a* when the wet tissue 2*a* is drawn out from the extraction hole 13. For this reason, the drawn wet tissue 2*a* is not squeezed and wrinkled, and hence the user may draw the wet tissue while maintaining the convenience in use. Accordingly, according to the wet tissue package 1 of this embodiment, it is possible to reduce the effort of the user in use, and hence largely prevent the complicatedness in use.

(Lid 17)

As illustrated in FIGS. 1 and 2, the upper surface of the bag body 3 is provided with the lid 17. The lid 17 is provided in an openable and closeable manner so as to seal the plucking hole 12 and the extraction hole 13 of the wet tissue package 1. For example, the lid is provided in the upper surface of the bag body 3 by hot-melt or the like. In the lid 17, a flexible film or a sheet-like flap is suitably used. An adhesive layer (not illustrated) is formed on the lower surface of the lid 17, and seals the inside of the bag body 3 when the adhesive layer adheres to the upper surface of the bag body 3. As the adhesive layer, for example, a pressure-sensitive adhesive may be exemplified which mainly includes acrylic adhesive paste, flexible polyvinyl chloride composition, and graftmer such as graft copolymer in which vinyl chloride monomer is graft-polymerized with ethylene-vinyl acetate copolymer, but the present invention is not limited thereto. In this embodiment, as illustrated in FIG. 1, the lid 17 is formed in a substantially rectangular shape having a forward plucking portion, but the shape is not limited as long as the plucking hole 12 and the extraction hole 13 may be sealed.

In the wet tissue package 1, the lid 17 is appropriately stuck to the upper surface of the bag body 3 or is partially peeled off therefrom in response to the operation of drawing out the sheet-like wet tissue 2*a*. When the lid 17 is stuck to the upper surface of the bag body 3, the inside of the bag body 3 may be air-tightly sealed by the adhesive layer, and hence the chemical solution and the like impregnated into the folded wet tissue body 2 does not evaporate. Furthermore, a portion that pops out from the extraction hole 13 in the wet tissue 2*a* is accommodated in the concave portion 11 formed in the base plate 10 when the lid 17 is stuck to the upper surface of the bag body 3. For this reason, it is possible to prevent a concern that the chemical solution and the like may evaporate from the portion that pops out from the extraction hole 13 in the wet tissue 2*a*.

Since the wet tissue package 1 of this embodiment is formed so that the folded wet tissue body 2 formed by folding the wet tissue 2*a* is accommodated in the bag body 3, the entire wet tissue package 1 may be decreased in size, and the manufacturing cost may be largely reduced.

Further, since the wet tissue package 1 is formed so that the folded wet tissue body 2 is accommodated in the accommodation container as the bag body 3, it is possible to suppress a concern that the wet tissue 2*a* is largely twisted when the front end of the wet tissue 2*a* is drawn out. For this reason, according to the wet tissue package 1, it is possible to reduce a concern that the drawn wet tissue 2*a* is largely wrinkled.

Moreover, in the wet tissue package 1 according to the present invention, a state in which the front end (which is also the front end of the wet tissue) of the folded wet tissue body 2 accommodated in the accommodation container pops out from the extraction hole toward the outside of the accommodation container is maintained after the wet tissue is raised and is separated by the planned separation portion 40. For this reason, it is possible to efficiently perform the operation in which the user draws out the next wet tissue, and hence to solve the complicatedness in which the front end of the wet tissue is plucked and drawn out from the inside of the accommodation container in each case.

In the wet tissue package according to the present invention, the base plate that is attached to the main bag body is not limited to the above-described configuration, and may be also a base plate to be described in the following second embodiment. That is, another type in which a member forming an extraction hole forming portion to be described later is attached to an attachment hole of a base plate body so as to form a base plate may be employed other than the above-described type in which the extraction hole forming portion is formed in the base plate.

Second Embodiment

A base plate 25 that is attached to a wet tissue package of a second embodiment will be described with reference to FIGS. 6 and 7. In a wet tissue package 21 of the second embodiment, the description of the same components as those of the wet tissue package 1 of the above-described first embodiment will not be repeated, and the same reference numerals will be used.

The wet tissue package 21 is formed so that a folded wet tissue body 22 is accommodated in a bag body 23 as an accommodation container.

As the folded wet tissue body 22, the folded wet tissue body 2 having the structure illustrated in FIG. 3B may be used, but the present invention is not limited thereto. In addition, as the folded wet tissue body 22, the folded wet tissue bodies 151 and 155 including the overlap portions 41 and 42 as the planned separation portion 40 may be used as illustrated in FIGS. 4A and 4B.

Figure 6:
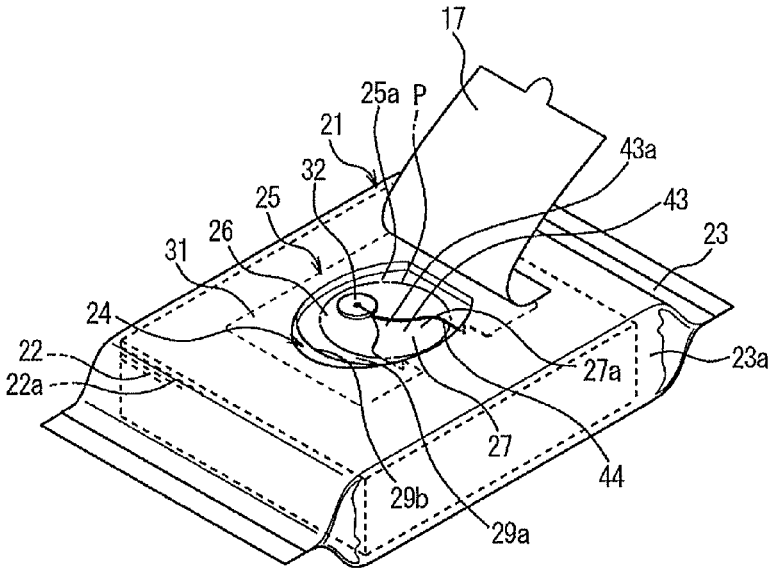
FIG. 6 is an external perspective view illustrating the external configuration of a wet tissue package according to a second embodiment of the present invention and is a view illustrating a state where a lid is opened.

As illustrated in FIG. 6, the bag body 23 is formed by bonding the base plate 25 to a main bag body 23*a*. The main bag body 23*a* is provided with an opening 24, and the base plate 25 is attached to the opening 24 by an appropriate bonding method using hot-melt or the like.

The base plate 25 is formed in a manner such that an extraction hole forming member 32 is attached to the base plate body 25*a* and the portion provided with the extraction hole forming member is the extraction hole forming portion. The base plate body 25*a* is a member that is formed of a thermoplastic resin material such as polyethylene and polypropylene by appropriately using an existing known method. The base plate body 25*a* is provided with a bottom surface 29*a* and a side wall portion 29*b* so that a concave portion 26 is formed at the center, where the side wall portion 29*b* is formed upright from the peripheral edge of the bottom surface 29*a* toward upward. Further, the concave portion 26 is provided with an attachment hole 28, and the notch portion 43 is formed at a predetermined position of the outer peripheral edge of the base plate body 25*a* corresponding to a predetermined position of the outer peripheral edge of the base plate 25 so as to face the center. Furthermore, a planar portion that is formed at the outside of the concave portion 26 and is indicated by the reference numeral 31 is an adhesion surface which is formed by attaching the base plate 25 to the bag body 23 by an appropriate method using hot-melt or the like.

The notch portion 43 is formed in a shape that is notched from a predetermined portion of the outer peripheral edge of the base plate body 25*a* toward the attachment hole 28, and forms the recessed portion 44 in the outer peripheral edge of the base plate 25 in the top view of the base plate 25. Further, as the notch portion 43 of the first embodiment, the notch portion 43 forms a part of a plucking hole 27 while the base plate 25 is attached to the bag body 3. As in the first embodiment, the notch portion 43 includes the notch extension portion 43*a*, and the notch extension portion 43*a* forms an extension portion 27*a* of the plucking hole 27 while the base plate 25 is attached to the bag body 23. Even in the second embodiment, the notch extension portion 43*a* of the notch portion 43 is formed in a shape that is sequentially tapered as it goes toward the attachment hole 28 as in the first embodiment.

Here, the plucking hole 27 is a hole through which the wet tissue 22*a* is plucked outward as in the plucking hole 12 described in the first embodiment. Further, the plucking hole 27 is formed by the notch portion 43 and a part of the edge of the opening 24 while the base plate 25 is attached to the bag body 23. More specifically, the plucking hole 27 is formed in the portion that is surrounded by a portion exposed to the outside from the opening 24 in the peripheral edge of the notch portion 43 and a portion intersecting the notch portion 43 of the base plate 25 in the edge of the opening 24. Further, the plucking hole 27 is opened in a size in which the wet tissue 22*a* of the folded wet tissue body 22 accommodated in the bag body 23 may be plucked. Further, the plucking hole 27 includes the extension portion 27*a*.

The attachment hole 28 is used to attach the extraction hole forming member 32 to be described later thereto, and is opened to the base plate body 25*a*. The attachment hole 28 is formed so as to communicate with the notch portion 43 through the notch extension portion 43*a*, and is formed in a size and a shape in which the extraction hole forming member 32 may be locked.

The extraction hole forming member 32 is formed by an elastic material that is softer than the base plate body 25*a* since the extraction hole forming portion is formed in the base plate 25. An existing known elastic material may be arbitrarily used in the extraction hole forming member 32, but it is desirable to use a rubber material such as natural rubber and synthetic rubber or an elastic material such as PP (polypropylene), PE (polyethylene), and vinyl resin from the viewpoint of the easy elastic deformation. Further, it is desirable to use silicon rubber or urethane rubber in a case where synthetic rubber is used.

Figure 7:
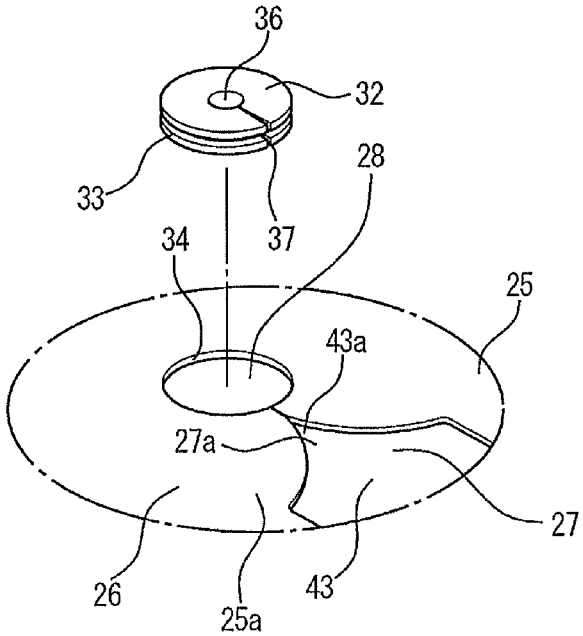
FIG. 7 is an enlarged exploded view illustrating an area P of FIG. 6 and is a partially enlarged exploded perspective view schematically illustrating a state where an extraction hole forming member is attached to an attachment hole.

As illustrated in FIG. 7, an extraction hole 36 is formed at the center portion of the extraction hole forming member 32 so as to serve as a through-hole formed in a substantially circular shape in the top view of the extraction hole forming member 32 and a slit 37 is formed by notching the extraction hole forming member from the extraction hole 36 toward the outer peripheral surface. A groove 33 is formed in the extraction hole forming member 32 so as to form an orbit moving around the outer peripheral surface. Further, the groove 33 intersects the slit 37, and the groove 33 is not formed at the intersection portion.

The base plate 25 is formed by fitting and locking the extraction hole forming member 32 to the attachment hole 28 of the base plate body 25*a* as below. That is, since an edge 34 of the attachment hole 28 of the base plate 25 is fitted to the groove 33 of the extraction hole forming member 32, the extraction hole forming member 32 is attached to the base plate 25 so as not to move freely in the up-down direction, the front-back direction, and the left-right direction.

Further, the extraction hole forming member 32 is fitted to the attachment hole 28 of the base plate body 25*a* while the formation position of the slit 37 matches the formation position of the notch extension portion 43*a* in the top view of the base plate 25. At this time, the base plate 25 is formed so that the notch portion 43 communicates with the extraction hole 36. Then, when the base plate 25 is attached to the bag body 23 so that the plucking hole 27 is formed by a part of the opening 24 of the bag body 23 and the notch portion 43, the plucking hole 27 communicates with the extraction hole 36.

According to the wet tissue package 21, since the plucking hole 27 and the extraction hole 36 are formed, the user may easily extract the wet tissue 22*a* while maintaining a state where the wet tissue 2*a* is not wrinkled, and hence the complicatedness in the operation of drawing out the wet tissue 2*a* and the complicatedness in use may be largely solved. Further, according to the wet tissue package 21 of this embodiment, since the extraction hole 36 is formed in the extraction hole forming portion formed of the elastic material, the hole diameter of the extraction hole 36 may be changed in response to the thickness of the wet tissue 22*a* passing through the extraction hole 36. Accordingly, when the user draws out the wet tissue 22*a*, the user may not feel a change in resistance caused by a change in the thickness of the wet tissue 22*a*, and may smoothly draw out the wet tissue 22*a*.

(Another Example of Extraction Hole Forming Member 32)

The extraction hole forming member 32 is not limited to the member provided with the extraction hole 36 that has a substantially circular shape in the plan view as described above. The extraction hole forming member 32 may be a member provided with the extraction hole 36 which is easily and elastically deformed and is formed so that the wet tissue 22*a* is reliably separated at the planned separation portion when the wet tissue is drawn out. For example, extraction hole forming members 45, 46, 47, or 48 respectively having the extraction holes in the shapes illustrated in the respective views of FIG. 8 may be attached to the base plate body 25*a* instead of the extraction hole forming member 36. Furthermore, it is assumed that the up-down direction and the left-right direction used to describe the configuration according to the modified example of the extraction hole forming member indicate the directions illustrated in FIG. 8.

Figure 8A:
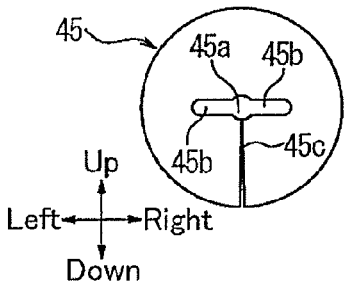
FIGS. 8A to 8D are views illustrating modified examples of the extraction hole forming member.

Specifically, the extraction hole forming member 45 with the extraction hole illustrated in FIG. 8A will be described. The extraction hole of the extraction hole forming member 45 is formed in a manner such that a substantially circular center hole 45*a* is opened to the center portion thereof and an elongated hole portion 45*b* is formed at each of the left and right sides of the center hole 45*a*. Then, the extraction hole forming member 45 is provided with a slit 45*c* that is provided below the center hole 45*a*. The slit is provided to the outer peripheral edge of the extraction hole forming member 45, and is disposed at the formation position of the notch extension portion 43*b* when the extraction hole forming member is attached to the base plate 25.

Figure 8B:
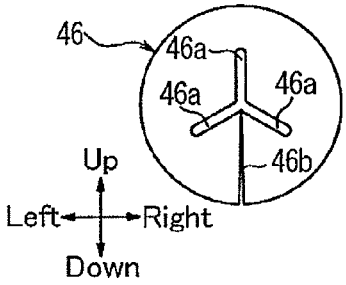

In the example of FIG. 8B, the extraction hole of the extraction hole forming member 46 is formed by three elongated hole portions 46*a*. The elongated hole portions 46*a* are formed at the interval of 120°. Further, a slit 46*b* is provided from a center portion 46*c* corresponding to the intersection of three elongated hole portions 46*a* to the outer peripheral edge of the extraction hole forming member 46.

Figure 8C:
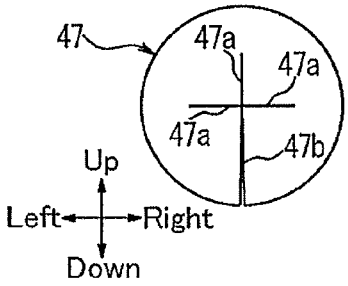

In the example of FIG. 8C, the extraction hole of the extraction hole forming member 47 is formed so that three linear slits 47*a* formed at the interval of 90° intersect one another, and a slit 47*b* that extends to the outer peripheral edge of the extraction hole forming member 47 is formed so as to extend from the intersection point of three slits 47*a*.

Figure 8D:
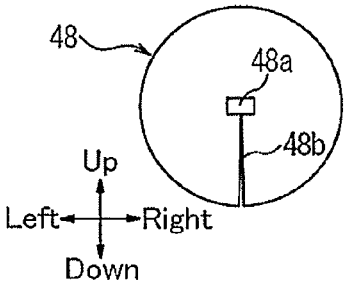

In the example of FIG. 8D, the extraction hole forming member 48 is provided with a rectangular extraction hole 48*a*. The extraction hole 48*a* may be formed in a rectangular shape, a rhombic shape, or a square shape. Further, a slit 48*b* is formed at the lower portion of the extraction hole 48*a* so as to extend from the extraction hole 48*a* to the outer peripheral edge of the extraction hole forming member 48.

(Another Example 1 of Base Plate)

Figure 9:
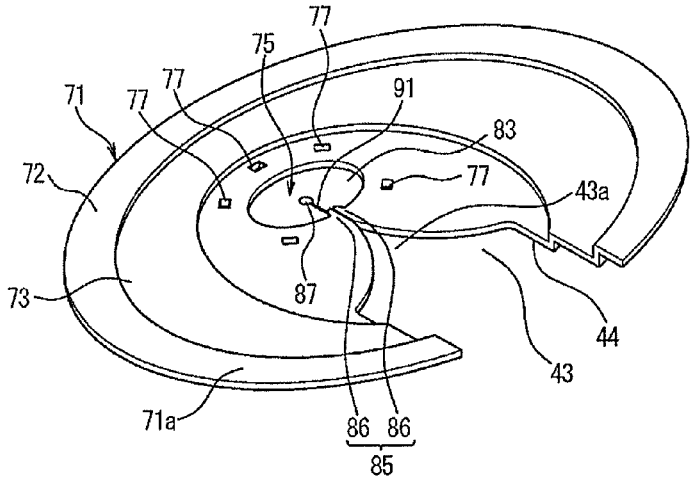
FIG. 9 is an external perspective view illustrating the external configuration of Another Example 1 of the base plate applied to the wet tissue package.
Figure 10:
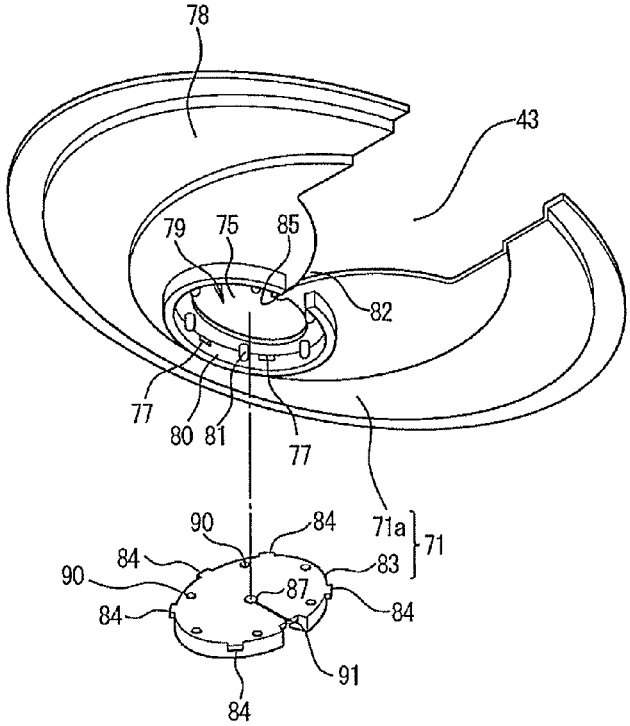
FIG. 10 is an exploded perspective view illustrating the configuration of the rear surface of the base plate illustrated in FIG. 9.

In the wet tissue package 21, the base plate that is attached to the position of the opening 24 is not limited to the base plate 25. In the wet tissue package 21, a base plate 71 may be attached to the opening 24 instead of the base plate 25 as illustrated in FIGS. 9 and 10. FIG. 9 is an external perspective view illustrating the external configuration of the base plate 71, and FIG. 10 is an exploded perspective view illustrating the configuration of the rear surface of the base plate 71.

(Configuration of Base Plate 71)

The base plate 71 is formed so that an extraction hole forming member 83 is attached to a base plate body 71*a* and the portion provided with the extraction hole forming member 83 forms the extraction hole forming portion. The base plate body 71*a* is formed of a thermoplastic resin material such as polyethylene and polypropylene, and is molded by an existing molding method. As illustrated in FIG. 9, the base plate body 71*a* is formed in an outline shape in which a compact having a substantially oval shape in the top view is partially notched inward from the outer peripheral edge thereof so as to have a predetermined size. At this time, the notched portion forms the notch portion 43, and the recessed portion 44 is formed in the outer peripheral edge of the base plate 25. Further, the base plate 71 is attached to the bag body 23 at the peripheral edge of the base plate body 71*a* by an arbitrary method using hot-melt or the like, and an adhesion surface 72 is formed in the peripheral edge thereof. At this time, the plucking hole 27 is formed by a part of the edge of the opening 24 of the bag body and the notch portion 43 of the base plate 71 while the base plate 71 is attached to the bag body 23. In the base plate 71, a portion is formed at the inside of the adhesion surface 72 of the base plate body 71*a* so as to be depressed in relation to the adhesion surface 72, and the depressed portion forms a concave portion 73. The concave portion 73 is provided with an opening hole 75. Further, in the notch portion 43 of the base plate 71, the tapered portion is provided with the notch extension portion 43*a*, and the tapered end of the notch extension portion 43*a* reaches the opening hole 75. Then, in the base plate 71, the notch portion 43 communicates with the opening hole 75.

The notch extension portion 43*a* of the notch portion 43 of the base plate 71 forms the extension portion 27*a* of the plucking hole 27 while the base plate 71 is attached to the bag body 23 as in the above-described notch extension portion 43*a* of the base plate 25. Furthermore, the plucking hole 27 is a hole through which the wet tissue 22*a* is plucked outward.

As illustrated in FIG. 10, in the lower surface of the base plate body 71*a*, a portion of which the front and rear sides are opposite with respect to the concave portion 73 protrudes, so that a downward convex portion 78 is formed. The downward convex portion 78 is provided with a lower wall portion 80 that surrounds the opening hole 75, and a space surrounded by the lower wall portion 80 forms an attachment portion 79. As for the positional relation between the formation position of the lower wall portion 80 and the formation position of a locking hole 77, the locking hole 77 is formed at the formation position of the lower wall portion 80 in the top view of the base plate body 71*a*. Further, the locking hole 77 is formed so that the locking hole is bored from the upper surface of the base plate 71 to the lower surface thereof and is bored to a predetermined position of the inner peripheral surface of the lower wall portion 80. In this way, the locking hole 77 is formed so that the upper surface of the base plate 71 communicates with the inner peripheral surface of the lower wall portion 80. The locking hole 77 is formed in a size and a shape in which a rib 84 of the extraction hole forming member 83 attached to the lower surface of the base plate body 71 may be locked to the locking hole. Such a locking hole 77 is formed at a plurality of positions so as to correspond to the rib 84 of the extraction hole forming member 83. Further, the attachment portion 79 is provided with a plurality of bosses 81 that are located between the lower wall portion 80 and the opening hole 75.

Incidentally, a projection portion 85 that protrudes toward the inside of the opening hole 75 may be formed at a position connected to the notch extension portion 43*a* in the opening hole 75. The projection portion 85 is formed by two protrusion portions 86, and the protrusion portions 86 form an inner gap 82 of the notch extension portion 43*a*.

The extraction hole forming member 83 is formed by an elastic material that is softer than the base plate 71 since the extraction hole forming portion is formed. An existing known elastic material may be arbitrarily used in the extraction hole forming member 83, but it is desirable to use a rubber material such as natural rubber and synthetic rubber or an elastic material such as PP (polypropylene), PE (polyethylene), and vinyl resin from the viewpoint of the easy elastic deformation. Further, it is desirable to use silicon rubber or urethane rubber in a case where synthetic rubber is used.

As illustrated in FIG. 10, the extraction hole forming member 83 is formed in a shape corresponding to the shape of the attachment portion 79, and the plurality of ribs 84 are formed at the position of the upper end of the outer peripheral surface so as to protrude toward the outer periphery. The ribs 84 are formed at the positions corresponding to the locking holes 77 formed in the attachment portion 79 of the base plate 71. A plurality of receiving holes 90 are formed in the peripheral edge of the upper surface of the extraction hole forming member 83. The receiving holes 90 are formed at the positions corresponding to the plurality of bosses 81 formed in the base plate 71.

The extraction hole forming member 83 is provided with an extraction hole 87 that is formed at a center portion 89 thereof so as to penetrate the extraction hole forming member, and a slit 91 is formed between the extraction hole 87 and the outer peripheral end of the extraction hole forming member 83. In the extraction hole forming member 83, the portion provided with the slit 91 is thinned to the outer peripheral end. The slit 91 is formed at a position in which the slit is continuous to the slit-like gap formed by the notch extension portion 43*a* when the extraction hole forming member 83 is attached to the attachment portion 79 of the base plate 71.

(Formation of Base Plate 71)

The base plate 71 is formed by attaching the extraction hole forming member 83 to the attachment portion 79 of the base plate body 71*a* as below. That is, the boss 81 is inserted into the receiving hole 90 of the extraction hole forming member 83, and the rib 84 of the extraction hole forming member 83 is fitted into the locking hole 77, so that the extraction hole forming member 83 is locked and fixed to the attachment portion 79 of the base plate body 71*a*. At this time, the extraction hole 87 is located so as to face the upper surface of the base plate 71 from the opening hole 75. In this way, the base plate 71 is formed.

Furthermore, since the base plate 71 is formed in a manner such that the corresponding bosses 81 are respectively inserted into the plurality of receiving hole 90 and the corresponding ribs are locked to the plurality of locking holes, the extraction hole forming member 83 may be reliably positioned with respect to the base plate body 71*a*.

(Another Example 2 of Base Plate)

Figure 11:
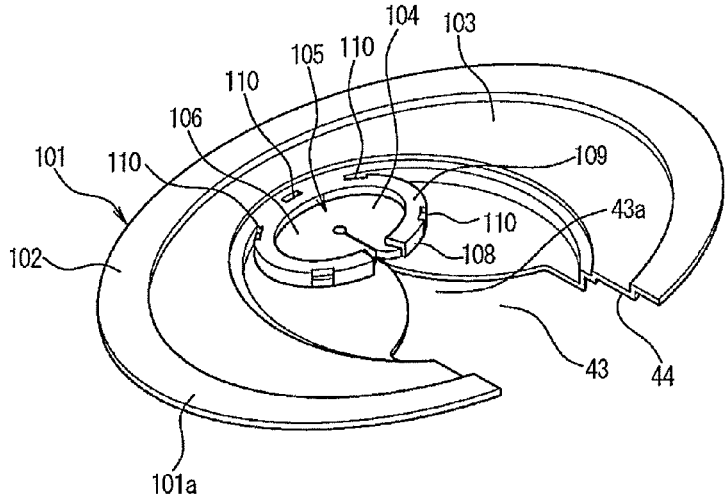
FIG. 11 is an external perspective view illustrating the external configuration of Another Example 2 of the base plate applied to the wet tissue package.
Figure 12:
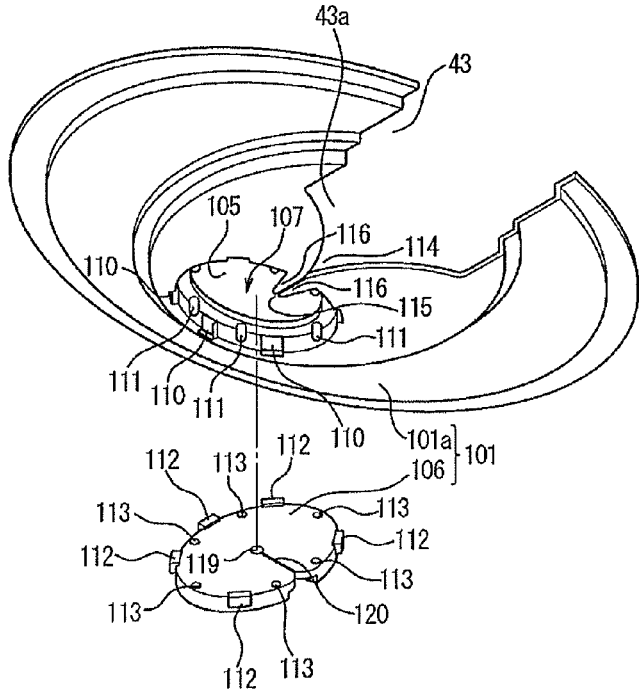
FIG. 12 is an exploded perspective view illustrating the configuration of the rear surface of the base plate illustrated in FIG. 11.

The base plate that is attached to the position of the opening 24 of the wet tissue package 21 is not limited to the base plate 25. A base plate 101 that is formed as illustrated in FIGS. 11 and 12 may be attached to the position of the opening 24 of the wet tissue package 21 instead of the base plate 25. FIG. 11 is an external perspective view illustrating the external configuration of the base plate 101, and FIG. 12 is an exploded perspective view illustrating the configuration of the rear surface of the base plate 101.

(Configuration of Base Plate 101)

The base plate 101 is formed so that an extraction hole forming member 106 is attached to a base plate body 101*a* and the portion provided with the extraction hole forming member 106 forms the extraction hole forming portion. The base plate body 101*a* is formed of a thermoplastic resin material such as polyethylene and polypropylene, and is molded by an existing known molding method. As illustrated in FIG. 11, the base plate body 101*a* is formed in an outline shape in which a compact having a substantially oval shape in the top view is partially notched inward from the outer peripheral edge thereof so as to have a predetermined size. Then, the notched portion forms the notch portion 43, and the recessed portion 44 is formed in the outer peripheral edge of the base plate 101. Further, the base plate 101 is attached to the bag body 23 at the peripheral edge of the base plate 101 by an arbitrary method using hot-melt or the like, and an adhesion surface 102 is formed in the peripheral edge thereof. At this time, the plucking hole 27 is formed by a part of the opening 24 of the bag body 23 and the notch portion 43 of the base plate 101. In the base plate 101, a portion is formed at the inside of the adhesion surface 102 so as to be depressed in relation to the adhesion surface 102, and the depressed portion forms the concave portion 103. The concave portion 103 is provided with an opening hole 105. Further, in the notch portion 43 of the base plate 101, the tapered portion is provided with the notch extension portion 43*a*, and the tapered end of the notch extension portion 43*a* reaches the opening hole 105. In this way, in the base plate 101, the notch portion 43 communicates with the opening hole 105.

In the base plate body 101*a* of the base plate 101, the opening hole 105 is formed in the concave portion 103, a side wall portion 108 is formed upright so as to surround the opening hole 105 while avoiding the notch portion 43, and an extension portion is formed at the upper edge of the side wall portion 108 toward the inside of the opening hole 105, thereby forming an upper surface wall portion 109. An opening is formed in the upper surface wall portion 109, so that an upper surface opening hole 104 is formed. Then, an attachment portion 107 is formed in the portion surrounded by the side wall portion 108 and the upper surface wall portion 109.

The attachment portion 107 is a portion to which the extraction hole forming member 106 is attached. In the attachment portion 107, a plurality of locking holes 110 are formed in the side wall portion 108, and a plurality of bosses 111 are formed in the lower surface of the upper surface wall portion 109 so as to extend downward.

In the opening hole 105, a projection portion 115 that protrudes toward the inside of the opening hole 105 is formed at the position connected to the notch extension portion 43*a*. The projection portion 115 is formed by two protrusion portions 116, and the protrusion portions 116 form an inner gap 114 of the notch extension portion 43*a*. The protrusion portions 116 suppress the plucked wet tissue 22*a* from moving from the extraction hole 119 formed in the extraction hole forming member 106 toward the plucking hole 27 when the wet tissue package 21 is used.

The extraction hole forming member 106 is formed of an elastic material that is softer than the base plate body 101*a* since the extraction hole forming member forms the extraction hole forming portion of the base plate 101. As the extraction hole forming member 106, the extraction hole forming member 83 described in the base plate 71 may be arbitrarily used, and the extraction hole forming member is formed by the existing known method.

The extraction hole forming member 106 is provided with an extraction hole 119 that is formed at the center portion thereof so as to penetrate the extraction hole forming member, and a slit 120 is formed between the extraction hole 119 and the outer peripheral end of the extraction hole forming member 106. The slit 120 is formed at a position in which the slit is continuous to the slit-like gap formed by the notch extension portion 43*a* when the extraction hole forming member 106 is attached to the attachment portion 107 of the base plate 101. The extraction hole forming member 106 is formed so that the portion provided with the slit 120 is thinner than the other portions.

In the extraction hole forming member 106, a plurality of ribs 112 are formed in the upper portion of the outer peripheral surface. A peripheral edge 117 of the extraction hole forming member 106 is provided with receiving holes 113. The receiving holes 113 are formed at the positions corresponding to the plurality of bosses 111.

(Formation of Base Plate 101)

The base plate 101 is formed by attaching the extraction hole forming member 106 to the attachment portion 107 of the base plate body 101*a* as below. That is, the boss 111 is inserted into the receiving hole 113 of the extraction hole forming member 106, and the rib 112 of the extraction hole forming member 106 is fitted to the locking hole 110, so that the extraction hole forming member 106 is locked and fixed to the attachment portion 107 of the base plate body 101*a*. At this time, the extraction hole 119 faces the upper surface of the base plate 101 from the upper surface opening hole 104. Furthermore, in a state where the extraction hole forming member 106 is locked and fixed to the attachment portion 107 of the base plate body 101*a*, the projection portion 115 formed in the base plate 101 is located below the lower surface of the extraction hole forming member 106.

(Another Example 3 of Base Plate)

Figure 13:
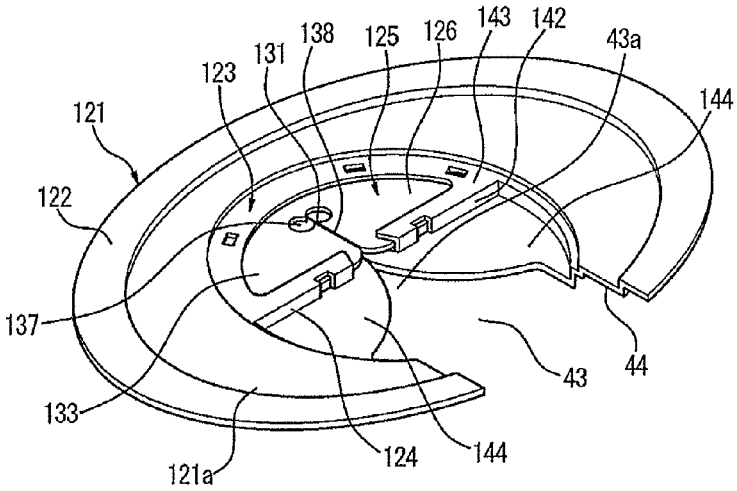
FIG. 13 is an external perspective view illustrating the external configuration of Another Example 3 of the base plate applied to the wet tissue package.
Figure 14:
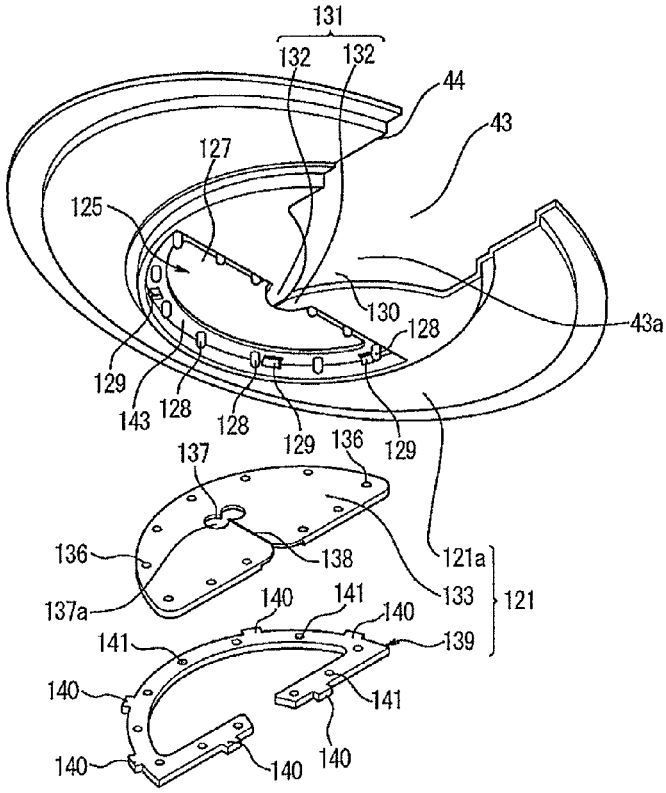
FIG. 14 is an exploded perspective view illustrating the configuration of the rear surface of the base plate illustrated in FIG. 13.
Figure 15:
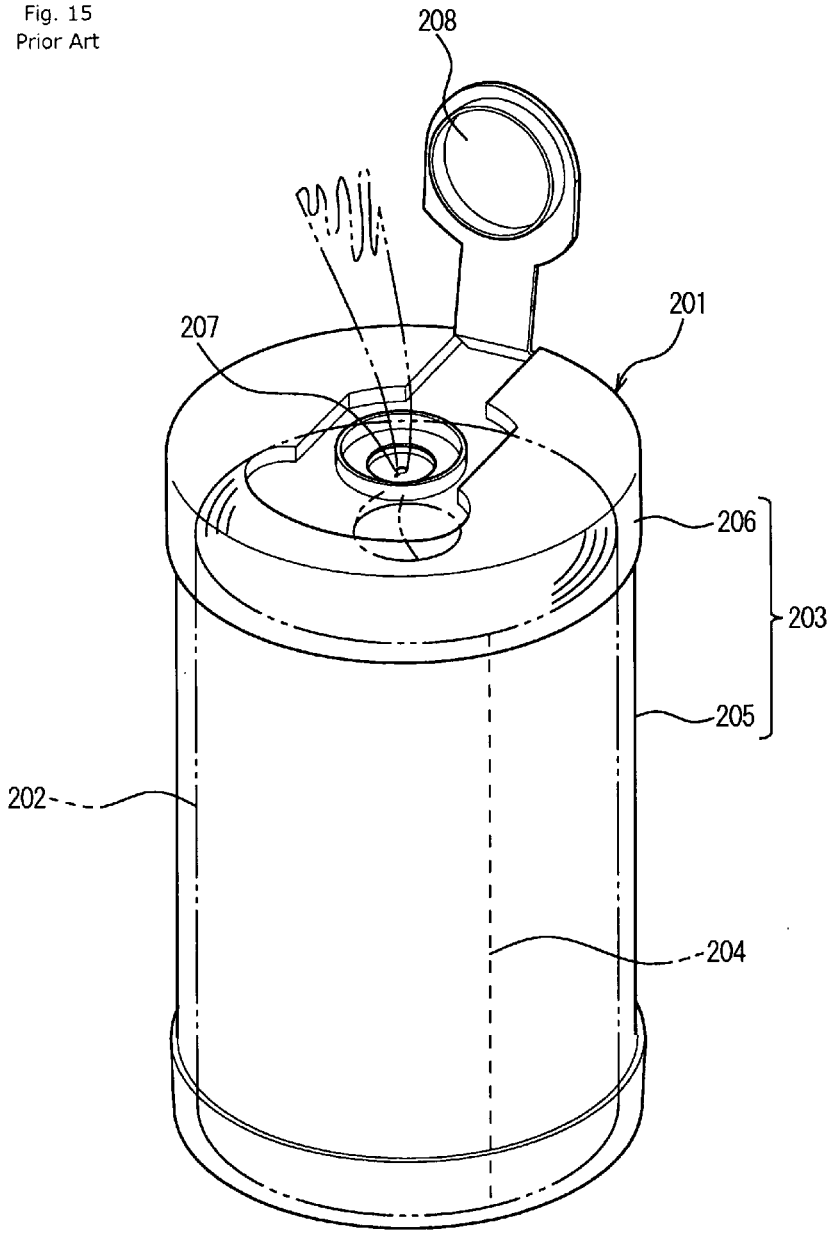
Fig. 15 Prior Art
FIG. 15 is an external perspective view illustrating the external configuration of a wet tissue package according to the related art.

The base plate that is attached to the position of the opening 24 of the wet tissue package 21 is not limited to the base plates 25, 71, and 101. A base plate 121 that is formed as illustrated in FIGS. 13 and 14 may be attached to the position of the opening 24 of the wet tissue package 21 instead of the base plate 25. FIG. 13 is an external perspective view illustrating the external configuration of the base plate 121, and FIG. 14 is an exploded perspective view illustrating the configuration of the rear surface of the base plate 121.

(Configuration of Base Plate 121)

The base plate 121 is formed so that an extraction hole forming member 133 is attached to a base plate body 121*a*, the base plate body 121*a* is fixed to the extraction hole forming member 133 by a fixing member 139, and the portion provided with the extraction hole forming member 133 forms the extraction hole forming portion.

The base plate body 121*a* is formed of a thermoplastic resin material such as polyethylene and polypropylene, and is molded by an existing known molding method. As illustrated in FIG. 13, the base plate body 121*a* is formed in an outline shape in which a compact having a substantially oval shape in the top view is partially notched inward from the outer peripheral edge thereof so as to have a predetermined size. Then, the notched portion forms the notch portion 43 of the base plate 121, and the recessed portion 44 is formed in the outer peripheral edge of the base plate 121. Further, the base plate 121 is attached to the bag body 23 at the peripheral edge of the base plate 121 by an arbitrary method using hot-melt or the like, and an adhesion surface 122 is formed in the peripheral edge thereof. At this time, the plucking hole 27 is formed by a part of the opening 24 of the bag body 23 and the notch portion 43 of the base plate 121. In the base plate 121, a portion is formed at the inside of the adhesion surface 122 so as to be depressed in relation to the adhesion surface 122, and the depressed portion forms a concave portion 123. The concave portion 123 is provided with an opening hole 127. Further, in the notch portion 43 of the base plate 121, the tapered portion is provided with the notch extension portion 43*a*, and the tapered end of the notch extension portion 43*a* reaches the opening hole 127. Then, in the base plate 121, the notch portion 43 communicates with the opening hole 127.

In the base plate body 121*a* of the base plate 121, the opening hole 127 having a substantially semi-lunar shape is formed in the concave portion 123. In the concave portion 123 of the base plate body 121*a*, an upright side wall portion 142 is formed upward between a notch portion entry compartment 144 (a compartment that is formed by a portion excluding the portion from the formation position of the side wall portion 142 to the portion near the opening hole 127) having a part of the notch portion 43 formed therein and a compartment formed in the portion forming the substantially semi-lunar opening hole 127. At this time, the side wall portion 142 is formed so as to avoid the communication portion between the notch portion 43 and the opening hole 127. Further, in the concave portion 123, an upper surface wall portion 143 is formed by extending the upper end of the side wall portion 142 toward the opening hole 127. The concave portion 123 is provided with a step 124 that is formed between the notch portion entry compartment 144 and the upper surface wall portion 143. Further, the upper surface wall portion 143 is opened so as to form an upper surface opening hole 126.

In the lower surface of the base plate body 121*a*, a portion of which the front and rear sides are opposite with respect to the concave portion 123 at the upper surface of the base plate 121 protrudes in a convex shape. In the portion that protrudes in a convex shape, an attachment portion 125 is formed in a portion that is defined from the side wall portion 142 by the upper surface wall portion 143. In the attachment portion 125, a plurality of bosses 128 are formed at a predetermined interval in the lower surface of the upper surface wall portion 143 of the base plate body 121*a* so as to protrude downward. Further, the attachment portion 125 is provided at a predetermined interval with a locking hole 129 into which a rib 140 formed in the fixing member 139 is fitted.

A projection portion 131 that protrudes toward the opening hole 127 is formed in the portion provided with the notch extension portion 43*a* at the lower surface of the base plate body 121*a*. The projection portion 131 suppresses the wet tissue to be drawn from moving from an extraction hole 137 toward the plucking hole 27 when the wet tissue is drawn out from the extraction hole 137 of the extraction hole forming member 133 attached to the base plate 121 in the wet tissue package 21. The projection portion 131 is formed by two protrusion portions 132 that extend from the portion forming a gap 130 in the notch extension portion 43*a*.

The extraction hole forming member 133 is formed of an elastic material softer than the base plate body 121*a* since the extraction hole forming member forms the extraction hole forming portion of the base plate 121. The extraction hole forming member 133 may be formed by arbitrarily using an existing known method. Further, the material described in the extraction hole forming member 83 may be arbitrarily selected and used in the material used in the extraction hole forming member 133.

Further, an extraction hole 137 is formed at a center portion 135 of the extraction hole forming member 133 so as to penetrate the extraction hole forming member, and a slit 138 is formed between the extraction hole 137 and the outer peripheral end of the extraction hole forming member 133. The slit 138 is formed at a position continuous to the tapered gap 130 formed by the notch extension portion 43*a* when the extraction hole forming member 133 is attached to the attachment portion 125 of the base plate body 121*a*. Further, the extraction hole forming member 113 is formed in a substantially semi-lunar outline shape so as to match the opening hole 127, and a peripheral edge 134 is provided with through-holes 136. These through-holes 136 are formed at the positions where the bosses 128 formed in the attachment portion 125 may be inserted therethrough when the extraction hole forming member 133 is attached to the base plate body 121*a*.

The extraction hole 137 is formed in a shape in which two circles partially overlap each other, and a projection structure 137*a* is formed in the portion that is formed so as to protrude by the overlap of two circles. The projection structure 137*a* further increases the friction resistance force that is applied to the wet tissue passing through the extraction hole 137.

The fixing member 139 is provided so as to suppress the extraction hole forming member 133 from being separated from the attachment portion 125 of the base plate 121. It is desirable that the fixing member 139 be formed of a rigid material such as plastic. The fixing member 139 is formed so that the outer peripheral shape thereof is substantially the same as that of the extraction hole forming member 133, and a plurality of protrusion portions 140 are formed protrudingly at a predetermined interval in the outer peripheral surface thereof. The protrusion portions 140 are formed at the positions where the protrusion portions may be locked to the locking holes 129, and each protrusion portion is formed in a shape in which the protrusion portion may be continuously locked to the locking hole 129. Further, in the fixing member 139, fixing holes 141 are formed at the same interval as that of the through-holes 136 of the extraction hole forming member 133 so as to be opened from the positions. The fixing hole 141 is formed so that the inner diameter thereof is substantially equal to the outer diameter of the boss 128.

(Formation of Base Plate 121)

The base plate 121 is formed by attaching the extraction hole forming member 133 and the fixing member 139 to the attachment portion 125 of the base plate body 121*a* as below. The extraction hole forming member 133 is fitted into the attachment portion 125 from the lower surface of the base plate body 121*a*. At this time, in the extraction hole forming member 133, the boss 128 is inserted through the through-hole 136. Further, the fixing member 139 is attached and fixed to the attachment portion 125 from the lower side of the extraction hole forming member 133. At this time, in the fixing member 139, the boss 128 is inserted through the fixing hole 141, and the protrusion portion 140 is locked to the locking hole 129. Furthermore, the projection portion 131 formed in the base plate body 121*a* is located below the lower surface of the extraction hole forming member 133 attached to the attachment portion 125.

As described above, the wet tissue package of the present invention has been described, and the present invention below may be read from the content described in the specification.

That is, the present invention of (1) to (11) may be read as below.

(1) A wet tissue package comprising: a folded wet tissue body that includes a planned separation portion formed to separate a wet tissue; an accommodation container that is formed so as to accommodate the folded wet tissue body therein and is provided with an opening through which the wet tissue separated at the planned separation portion of the accommodated folded wet tissue body is drawn to the outside; and a base plate that is attached to the opening and forms a notch portion at a predetermined position of the base plate, wherein the notch portion is formed so that a plucking hole, through which the wet tissue is plucked to the outside, is formed by the notch portion and a part of the edge of the opening while the base plate is attached to the opening; and an extraction hole that communicates with the plucking hole and is formed so that the wet tissue is separated at the planned separation portion so as to be extracted and a lid that is formed in an openable and closable manner so as to seal the plucking hole and the extraction hole.

(2) The wet tissue package according to (1), wherein the extraction hole is formed so as to apply a friction resistance to the plucked wet tissue.

(3) The wet tissue package according to (1) or (2), wherein the extraction hole is opened to the base plate.

(4) The wet tissue package according to any of (1) to (3), wherein the extraction hole is provided with a projection portion that protrudes toward the inside of the extraction hole.

(5) The wet tissue package according to (4), wherein the extraction hole is provided with a protrusion that is formed at a position facing the projection portion.

(6) The wet tissue package according to any of (1) to (5), wherein the base plate is provided with an extraction hole forming portion that is formed of an elastic material, and the extraction hole is formed in the extraction hole forming portion.

(7) The wet tissue package according to (6), wherein the extraction hole is formed so that the hole diameter thereof changes in response to the thickness of the wet tissue passing through the extraction hole.

(8) The wet tissue package according to (6) or (7), wherein the base plate includes an extraction hole forming member and a base plate body provided with an attachment portion forming an extraction hole forming portion by attaching the extraction hole forming member thereto, the extraction hole forming member is provided with a hole portion that is attached to the attachment portion, and the attachment portion is provided with a boss that is press-insertable into the hole portion.

(9) The wet tissue package according to any of (6) to (8), wherein the base plate includes an extraction hole forming member and a base plate body provided with an attachment portion forming an extraction hole forming portion by attaching the extraction hole forming member thereto, the extraction hole forming portion is provided with a rib that protrudes outward from the outer periphery of the extraction hole forming portion, and the attachment portion is provided with a locking hole to which the rib is lockable.

(10) The wet tissue package according to any of (6) to (8), wherein the base plate includes an extraction hole forming member, a base plate body provided with an attachment portion forming an extraction hole forming portion by attaching the extraction hole forming member thereto, and a fixing member that attaches and fixes the extraction hole forming portion to the attachment portion, the fixing member is provided with a fixing hole through which a boss is insertable and a protrusion portion is formed so as to protrude outward from the outer periphery of the fixing member, and the attachment portion is provided with a locking hole to which the protrusion portion is lockable.

(11) The wet tissue package according to any of (1) to (10), wherein the notch portion includes an extension portion that extends toward the extraction hole and communicates with the extraction hole, and the extension portion is formed in a sequentially tapered shape as it goes toward the extraction hole and communicates with the extraction hole.

INDUSTRIAL APPLICABILITY

The present invention may be usefully used at home as a wet tissue that is used to wipe a body and the like.

REFERENCE SIGNS LIST

1, 21 Wet tissue package
2, 22 Folded wet tissue body
2*a*, 22*a* Wet tissue
3, 23 Bag body
4 Planned disjoining portion
5 First turnback portion
6 Second turnback portion
9, 24 Opening
10, 25, 71, 101, 121 Base plate
12, 27 Plucking hole
12*a*, 27*a* Extension portion
13, 36, 87, 119, 137 Extraction hole
17 Lid
32, 83, 106, 133 Extraction hole forming member
43 Notch portion
3*a* Notch extension portion
39 Fixing member
160 Accommodation container

The invention claimed is:

1. A wet tissue package comprising:

a folded wet tissue body that includes a planned separation portion formed to separate a wet tissue;

an accommodation container that is formed so as to accommodate the folded wet tissue body therein and is provided with an opening through which the wet tissue forming the accommodated folded wet tissue body is drawable to the outside;

a base plate that is attached to the opening and forms a notch portion at a predetermined position of the base plate, wherein the notch portion is formed so that a plucking hole, through which the wet tissue is plucked to the outside, is formed by the notch portion and a part of the edge of the opening while the base plate is attached to the opening;

an extraction hole that communicates with the plucking hole and is formed so that the wet tissue is separable from the folded wet tissue body at the planned separation portion; and a lid that is formed in an openable and closable manner so as to seal the plucking hole and the extraction hole, wherein the notch portion on the base plate extends from an outer peripheral edge of the base plate toward the extraction hole.

2. The wet tissue package according to claim 1, wherein the notch portion includes an extension portion that extends toward the extraction hole and communicates with the extraction hole, and the extension portion is formed in a sequentially tapered shape as it goes toward the extraction hole and communicates with the extraction hole.

3. The wet tissue package according to claim 1, wherein the base plate is provided with an extraction hole forming portion formed of an elastic material, and the extraction hole is formed in the extraction hole forming portion.

4. The wet tissue package according to claim 3, wherein the base plate includes an extraction hole forming member and a base plate body provided with an attachment portion forming the extraction hole forming portion by attaching the extraction hole forming member thereto, the extraction hole forming member is provided with a hole portion that is attached to the attachment portion, and the attachment portion is provided with a boss that is press-insertable into the hole portion.

5. The wet tissue package according to claim 3, wherein the base plate includes an extraction hole forming member and a base plate body provided with an attachment portion forming the extraction hole forming portion by attaching the extraction hole forming member thereto, the extraction hole forming member is provided with a rib that protrudes outward from the outer periphery of the extraction hole forming member, and the attachment portion is provided with a locking hole to which the rib is lockable.

6. The wet tissue package according to claim 2, wherein the base plate is provided with an extraction hole forming portion formed of an elastic material, and the extraction hole is formed in the extraction hole forming portion.

7. The wet tissue package according to claim 3, wherein the base plate includes the extraction forming member and a base plate body provided with an attachment portion forming an extraction hole forming portion by attaching the extraction hole forming member thereto, the extraction hole forming member is provided with a hole portion that is attached to the attachment portion, and the attachment portion is provided with a boss that is press-insertable into the hole portion.

8. The wet tissue package according to claim 3, wherein the base plate includes an extraction hole forming member and a base plate body provided with an attachment portion forming the extraction hole forming portion by attaching the extraction hole forming member thereto, the extraction hole forming member is provided with a rib that protrudes outward from the outer periphery of the extraction hole forming member, and the attachment portion is provided with a locking hole to which the rib is lockable.

* * * * *